United States Patent [19]

Martin et al.

[11] 4,030,431

[45] June 21, 1977

[54] SEWING MACHINE TAKE-UP THREAD SHIELD

[75] Inventors: Adolph Martin, Rheinstetten-Neu, Germany; William Joseph Edwards, Cranberry, N.J.

[73] Assignee: The Singer Company, New York, N.Y.

[22] Filed: May 24, 1976

[21] Appl. No.: 688,880

[52] U.S. Cl. ..... 112/241; 112/261

[51] Int. Cl.[2] ..... D05B 49/00

[58] Field of Search ..... 112/241, 245, 57, 96, 112/261

[56] References Cited

UNITED STATES PATENTS

| | | | |
|---|---|---|---|
| 1,142,360 | 6/1915 | Onderdork | 112/241 |
| 1,906,087 | 4/1933 | Parkes | 112/241 |
| 2,173,320 | 9/1939 | De Voe | 112/241 |
| 3,310,015 | 3/1967 | Gegauf, Jr. | 112/241 |
| 3,756,176 | 9/1973 | Wittler et al. | 112/241 |

*Primary Examiner*—Werner H. Schroeder
*Assistant Examiner*—Moshe I. Cohen
*Attorney, Agent, or Firm*—Edward L. Bell; Robert E. Smith; Edward P. Schmidt

[57] ABSTRACT

A thread shield, for a sewing machine having means to interrupt needle bar reciprocation and a take-up with a threading slot to an eyelet thereof, to discourage thread escape from the eyelet or double threading of the eyelet by loose, slung around thread. The sewing machine take-up moves in an up and down path from an uppermost position, where thread may be drawn to the eyelet by way of the threading slot, to a lower position where appreciable slack thread forms when the needle bar reciprocation is interrupted. At the position where appreciable slack thread forms, the take-up moves closely adjacent to an upstanding rib which overlaps the entry to the threading slot thus to deter thread loops from reentering the threading slot. The forward surface of the upstanding rib is tapered in a horizontal plane towards the take-up lever to impede thread, which might otherwise move from the eyelet rearwardly down the threading slot to the threading slot entry. The forward surface of the upstanding rib is also curved in a vertical plane to form a minimum angle of 90° with the projection of the top surface of the take-up lever on the vertical plane, to discourage a loop of thread slung about the take-up from being drawn back during the up stroke of the take-up to a position where it will re-enter the threading slot to double thread or unthread the take-up.

5 Claims, 4 Drawing Figures

SEWING MACHINE TAKE-UP THREAD SHIELD

BACKGROUND OF THE INVENTION

The invention is concerned with a device to discourage thread escape from a sewing machine take-up lever to which thread entry may be achieved by way of a threading slot passing from an external surface of the take-up lever to a thread carrying eyelet.

There are in the prior sewing machine art many examples of so called "self threading" take-up levers where thread entry may be achieved by means of a threading slot. An example of such a take-up lever may be had by reference to the U.S. Pat. No. 3,756,176, issued Sept. 4, 1973. Additionally, in the prior art there are examples of sewing machine take-up levers where the threading slot is a tortuous pathway, or presents an impeded pathway to enable thread to be drawn to the thread carrying eyelet, but would present a substantial barrier to escape of loose thread from the eyelet due to the low likelihood of the loose thread assuming the shape necessary to pass back through the tortuous or impeded pathway. Examples of such take-up levers may be had by reference to the U.S. Pat. No. 3,310,015, issued Mar. 21, 1967.

Sewing machine take-up levers as disclosed in the above cited patents have met, with varying degrees of success, the problem of thread escape from the thread carrying eyelet in normal sewing with the usual sewing machine wherein the thread carrying eyelet and part of the take-up lever protrude and operate externally of the sewing machine frame. In this environment, the take-up lever disclosed in the U.S. Pat. No. 3,756,176 cited above has proven effective in detering unthreading or double threading when using difficult thread materials, such as silk and some synthetic materials; or when using a basting stitch device of the type wherein the needle bar remains stationary while the take-up lever continues its up and down movement, resulting in loose slung around thread which may be thrown about the take-up lever during its up stroke. In the latter case the problem had been particularly acute in that there is sufficient slack thread to permit unthreading or double threading for almost every up and down movement of the take-up. However, where the take-up operates within a cavity in the sewing machine frame the problem has once again been found to exist where the thread moved out of the thread carrying eyelet via the threading slot, or where the take-up lever was unthreaded or double threaded by, for example, a loop cast about the take-up lever while the sewing machine is in the basting stitch mode.

What is required is an effective and economical means of permitting the desirable, safe operation of a sewing machine take-up lever within a cavity in a sewing machine frame without incurring unthreading or double threading of the thread carrying eyelet, whether with difficult thread materials or with the sewing machine in the basting stitch mode.

SUMMARY OF THE INVENTION

The above requirement is achieved by a thread shield device positioned in the sewing machine head to be adjacent the take-up lever in its up and down motion at a point when sufficient slack thread begins to form which could create a problem of the take-up lever unthreading by passage of thread out of the thread carrying eyelet by way of the threading slot, or of rethreading or double threading of the take-up lever by means of a loop of thread slung about the take-up lever to re-enter the eyelet by way of the threading slot. The thread shield device comprises an upstanding arm positioned immediately adjacent the take-up lever in covering relationship to the threading slot entry opening and a portion of the threading slot, and extends over that portion of the take-up lever up and down motion below the uppermost extreme thereof. The forward edge of the upstanding arm is beveled forwardly, in a horizontal plane towards the take-up lever to discourage slack thread motion down the threading slot towards the entry opening and, thereby, out of the take-up lever. In a vertical plane, the forward edge of the upstanding arm is contoured to form at least a 90° angle with the projection of the top surface of the take-up lever on the plane in order to encourage any slack thread thrown about the take-up lever to slide off the take-up lever in the forward direction away from the threading slot entry opening.

DESCRIPTION OF THE DRAWINGS

For a better understanding of the invention reference may be had to the specification and drawings in which:

In FIG. 1 is shown the head end 10 of a sewing machine and a portion of the work supporting bed 11. The head end of the sewing machine frame 13 is closed off by a head end cover 14. A portion of a top cover 15 closing off the top of the sewing machine frame 13 is also visible. Supported beneath the top cover 15 by the sewing machine frame 13 is a portion of a control panel 17 including an operator access button 18.

Figure 1:
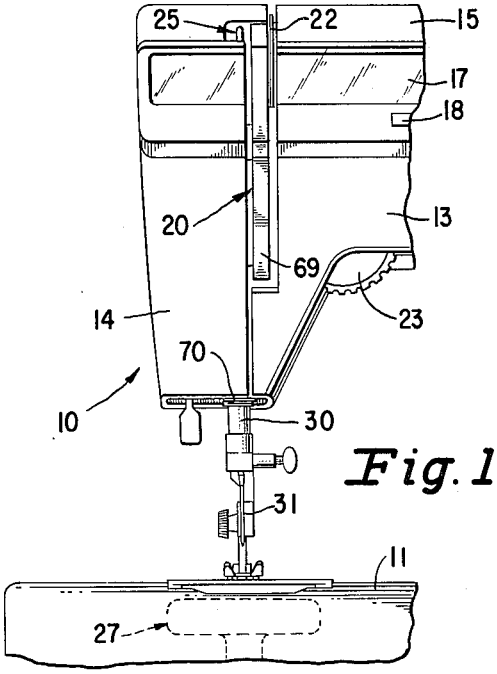
FIG. 1 is a front elevation of a head end of a sewing machine in which the invention may be incorporated.

Also supported by the sewing machine frame 13 is a thread tension plate 20 supporting thereon thread tension components 22 for applying top tension to a sewing thread as adjusted by tension dial 23. Just visible on the side of the thread tension plate 20 opposite the thread tension components 22 is a take-up lever 25, shown in the uppermost position of operation.

Figure 2:
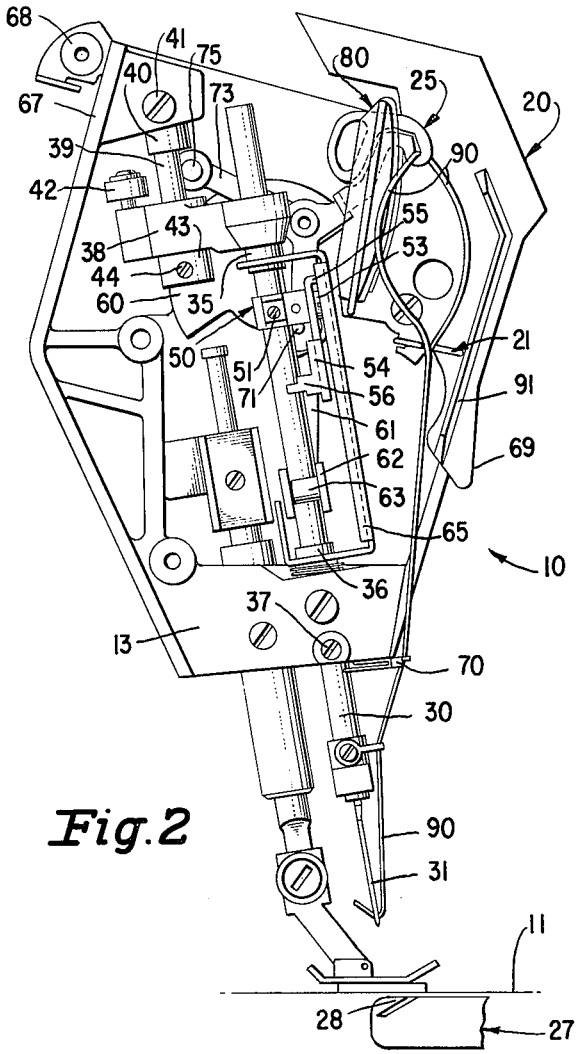
FIG. 2 is side elevation of the sewing machine shown in FIG. 1 with the covers and other parts thereof removed to show the details of the thread shield and take-up.

Referring to FIG. 2 there is shown a side elevation of the sewing machine shown in FIG. 1 with the head end cover 14, top cover 15 and a presssure regulating module supporting a basting solenoid (not shown) removed to show the details of the head end arrangement of the sewing machine. A needle bar 30, carrying a sewing needle 31 on one end thereof, is supported for endwise reciprocation in upper bearing 35 and lower bearing 36. The outer ends of the upper bearing 35 and lower bearing 36 are of spherical form and are received in sockets retained in a needle bar gate 38, and in the sewing machine frame 13 by screw 37. Thus angular motion of the needle bar 30, imparted by pivoting of the needle bar gate 38 about pivot post 39 under the influence of a driving arm 42, may be accommodated by the spherical ball and socket arrangements; while endwise reciprocation of the needle bar 30 may be accommodated within the upper bearing 35 and lower bearing 36. The pivot post 39 is fashioned with an eccentric 40, which is inserted into an opening in the sewing machine frame 13, and rotated to change the inclination of the needle bar 30 to a position where the needle 31 will cooperate with a looptaker 27, having a loop taking beak 28, located in the bed 11 of the sewing machine. The adjusted position of the eccentric 40 is locked by screw 41. The needle bar gate 38 is supported on the pivot post 39 by collar 43, clamped to the pivot post by screw 44.

The needle bar 30 is driven in endwise reciprocation though a latch mechanism 50 fastened to the needle bar by screw 51. The latch mechanism 50 includes a latch 54 pivotable about a shouldered screw 53, the latch having a forwardly turned ear 55 and a rearwardly directed arm 56. A rotating crank 60, supported on one end of a sewing machine armshaft (not shown), is connected by a connecting link 61 to a driving stud (not visible) having cheek pieces 62 on both sides of the needle bar 30. The cheek pieces 62 receive a collar 63 freely slidable on the needle bar 30. When the rearwardly directed arm 56 of the latch 54 is engaged with the cheek piece 62 of the driving stud, the needle bar 30 undergoes endwise reciprocation under the influence of the rotating crank 60. When, as is shown in FIG. 2, the rearwardly directed arm 56 of the latch 54 is not engaged with the cheek piece 62, the needle bar 30 is held in an elevated state by a tension spring (not shown) and the cheek pieces 62 and collar 63 freely slide on the needle bar without causing endwise reciprocation thereof.

The separation of the rearwardly directed arm 56 of the latch 54 from the cheek piece 62 is achieved by means of an unlatching frame 65 supported by and pivotable about the upper bearing 35 and the lower bearing 36 (see FIG. 2). The unlatching frame 65 may be rotated by the basting solenoid previously mentioned to bring a surface thereof into engagement with the forwardly turned ear 55 of the latch 54, to rotate the latch about the shouldered screw 53 and separate the rearwardly directed arm 56 from the cheek piece 62. Continued operation of the sewing machine may then take place without needle penetration for as long as the basting solenoid remains in the active state.

Also visible in FIG. 2 is the take-up lever 25, driven by the crank 60 at 71 and pivoted by idler link 73 about a post 75 affixed to the sewing machine frame 13. The take-up lever 25 operates within a cavity in the sewing machine. In the typical sewing machine, slack thread is provided, in a take-up lever 25, looptaker 27 and needle bar 30 combination, by the down stroke of the take-up lever to supply thread to the looptaker; and slack thread is taken up by the up stroke of the take-up lever. In FIG. 2, the needle bar 30 is shown in an elevated state, with the crank 60, connecting link 61, cheek pieces 62 and collar 63, and the take-up lever 25 in the position normally associated with the lowermost position of the needle bar; in other words the sewing machine is shown in the basting mode of operation. The take-up lever 25 has moved downwardly from its uppermost position, and, since there has been no motion of the sewing needle, an appreciable amount of slack thread 90 has been generated. The take-up lever 25 has moved below the top of the thread tension plate 20, and behind a thread shield device 80.

Figure 3:
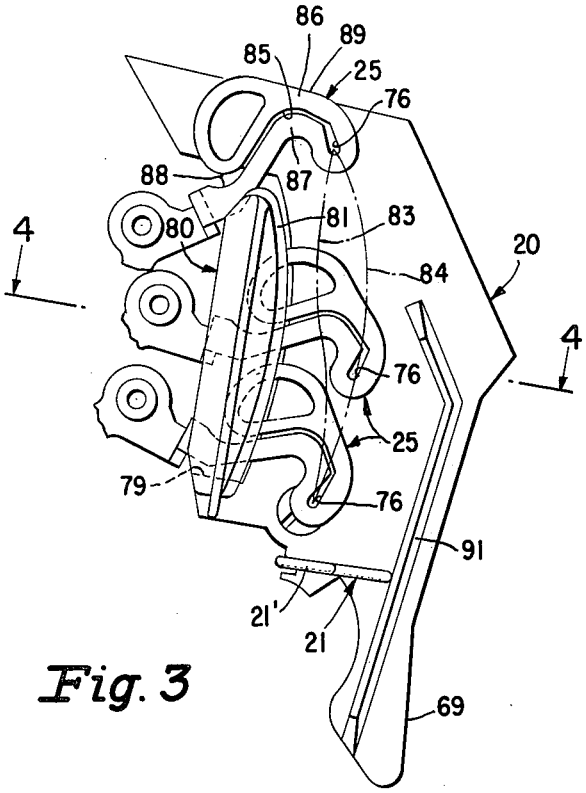
FIG. 3 is an enlarged view of the thread shield as shown in FIG. 2 with the take-up lever shown in full in its uppermost and lowermost positions, and in an intermediate position of its up motion; and, FIG. 4 is a cross section of the thread shield and take-up lever taken substantially along line 4—4 of FIG. 3, with the take-up lever in its lowermost position.

In FIG. 3 is shown an enlarged view of the thread tension plate 20 and thread shield device 80 formed as part of the thread tension plate. There is also shown in dot-dash line the motion of the eyelet 76 of the take-up lever 25 in its down path 83 and up path 84. In its down motion the take-up lever 25, and the eyelet 76 thereof, moves along the inner path 83, with the take-up lever maintaining the orientation shown in FIG. 2 for all positions but the lower most position shown in FIG. 3. The progress of the take-up lever 25 in its up motion is clearly depicted in FIG. 3. The take-up lever 25 is fashioned with a threading slot 85 formed by a top portion 86 of the take-up lever overlying a bottom 87 thereof, and having a thread entry 88 opening accessible from the top of the take-up lever. The take-up lever 25 in FIG. 3 is shown in full in its uppermost position, in its lowermost position and at an intermediate position during its up-stroke to indicate a desirable relationship with the thread shield device 80 which will be discussed below. In FIG. 2, the take-up lever 25 is, as stated above, shown in an intermediate position during its down-stroke. Threading of the sewing machine is accomplished with the take-up lever 25 in its uppermost position shown in FIGS. 1 and 3, from a thread supply supported in the back 67 of the sewing machine frame 13. By reference to FIGS. 1 to 3 it may be seen that a thread 90 from a thread supply (not shown) may be drawn into a pretension device 68 supported adjacent the back 67 of the sewing machine frame 13 and aligned with the thread tension components 22 (see FIGS. 1 and 2). The thread 90 may be brought forward into engagement with the thread tension components 22 and then downwardly about a protuberance 69 on the lower part of the thread tension plate 20. The thread 90 is guided upwardly by the configuration of the protuberance 69 into engagement with pivot rod 21 of a material resistant to thread wear at a corner formed by a lateral extension 21' of the pivot rod, which is carried by the thread tension plate 20. The thread 90 may then be drawn backwardly to behind the top portion 86 of the take-up lever 25 and into the thread entry 88, and then forwardly into the thread eyelet 76, when the thread take-up lever is in the uppermost position shown in FIG. 3. The thread 90 will then pass through the thread snub 70 and to the sewing needle 31.

Figure 4:
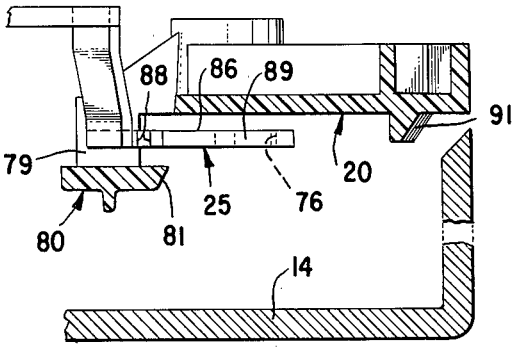

The thread shield 80 is as stated above, formed as part of the thread tension plate 20. In FIG. 4, a cross section taken along line 4—4 of FIG. 3 with the take-up lever 25 in the lowermost position, a laterally extending portion 79 of the thread tension plate 20 supports the upwardly extending thread shield device 80 closely adjacent the take-up lever 25 in covering relationship to the thread entry 88 (see also FIG. 3). The thread shield device extends upwardly a distance sufficient to initiate the aforementioned covering relationship whenever the take-up lever 25, in moving downwardly from the uppermost position shown in FIG. 3 while the sewing machine is in the basting stitch mode, generates a quantity of slack thread 90, as is depicted in FIG. 2, which may permit the thread to move out of the eyelet 76 to the threading slot 85. The forward surface 81 of the thread shield 80 is beveled towards the take-up lever 25 (see FIG. 4) to discourage the thread 90, which may have moved into the threading slot 85 of the take-up lever and against the forward surface of the thread shield, from any further retrograde movement towards the thread entry 88 of the take-up lever. The forward surface 81 of the thread shield 80 is also curved in a vertical plane to maintain an angle of at least 90° with the projection of the top surface 89 of the top portion 86 of the take-up lever 25 on the vertical plane during the up stroke of the take-up lever. Thus, if a loop of slack thread 90 is slung about the take-up lever 25 and against the forward surface 81 of the thread shield device 80, the thread will not be caught in an acute angle between the top surface 89 of the take-up lever and the forward surface 81 of the thread shield device 80 to be drawn back to the thread entry 88 of the take-up lever during its upward motion. Instead, by the combination of a minimum angle of 90° between the top surface 89 of the take-up lever 25 and the forward surface 81 of the thread shield device 80 during the up stroke of the take-up lever, and the smooth, burr free edges provided for thread handling components of sewing machines, including take-up levers, a thread loop will normally be sloughed forwardly and off the top portion 86 of the take-up lever. An auxiliary shield 91 is provided on the thread tension plate 20 forwardly of the take-up lever 25 to deter slack thread 90 from being slung around outside the head end cover 14.

Having thus set forth the nature of the invention what is claimed is:

1. In a sewing machine having a frame; a needle carrying bar supported for endwise reciprocation by said frame; a looptaker journaled in said frame for cooperation with said needle carrying bar in the formation of stitches; a take-up lever having an uppermost edge, a thread carrying eyelet and a threading slot passing from an opening in said uppermost edge to said thread carrying eyelet; said take-up lever being carried by said frame to undergo reciprocatory motion in a substantially vertical path from an uppermost position to a lowermost position in cooperative arrangement with said looptaker and said needle carrying bar; actuating mechanism for imparting endwise reciprocation to said needle carrying bar and motion in said vertical path to said take-up lever; wherein the improvement comprises a thread shield lug extending upwardly in a plane parallel to the path of motion of said take-up lever and closely adjacent said opening in said uppermost edge and a portion of said threading slot from said lowermost position of said take-up lever to a point immediately below said uppermost position of said take-up lever, said thread shield lug having a forward surface closest to said thread carrying eyelet beveled forwardly in a horizontal plane towards said take-up lever.

2. In a sewing machine having a frame; a needle carrying bar supported for endwise reciprocation by said frame; a looptaker journaled in said frame for cooperation with said needle carrying bar in the formation of stitches; a take-up lever having an uppermost edge, a thread carrying eyelet and a threading slot passing from an opening in said uppermost edge to said thread carrying eyelet; said take-up lever being carried by said frame to undergo up and down motion from an uppermost position to a lowermost position in cooperative arrangement with said looptaker and said needle carrying bar; a releasable latch mechanism supported on said needle carrying bar; actuating mechanism for imparting endwise reciprocation to said needle carrying bar through said releasable latch mechanism and up and down motion to said take-up lever; wherein the improvement comprises a thread shield lug extending upwardly in a plane parallel to said take-up lever up and down motion and closely adjacent said opening in said uppermost edge and a portion of said threading slot from said lowermost position of said take-up lever to a point immediately below said uppermost position of said take-up lever, said thread shield having a forward surface closest to said carrying eyelet beveled forwardly in a horizontal plane towards said take-up lever.

3. In a sewing machine as claimed in claim 2 wherein said forward surface of said thread shield is curved in a vertical plane to maintain a minimum angle of 90° with the projection on the vertical plane of said uppermost edge of said take-up lever.

4. In a sewing machine as claimed in claim 3 wherein said take-up lever undergoes said up and down motion within an upwardly open cavity in said sewing machine frame.

5. In a sewing machine having a frame, stitch forming instrumentalities including a thread carrying needle endwise reciprocable in said frame, a loop taker carried in said frame for movement in cooperation with said needle to concatenate said needle thread in the formation of stitches, a take-up lever formed with a needle thread engaging eyelet and supported for movement of said eyelet within said frame, means for imparting movement to said take-up lever in timed relation with said needle and loop taker and in a path alternately to provide slack in said needle thread for concatenation by said loop taker and to withdraw slack in said needle thread to set stitches, said take-up lever being formed with a thread introduction slot leading from said eyelet to a mouth which is located externally on said take-up lever and which is accessible to the needle thread when slack is provided therein by the movement of said stitch forming instrumentalities, means for preventing accidental unthreading of the take-up lever eyelet comprising: a thread shield formed with a take-up lever accommodating passageway having an open extremity; means for supporting said thread shield on said sewing machine frame with said passageway aligned with the path of motion of said take-up lever, with said thread shield extending between said take-up eyelet and said thread introduction slot mouth over that portion of the path of motion of said take-up lever in which sufficient slack thread is provided in order to make unthreading possible and with said open slot extremity arranged to expose said take-up lever over that portion of the path of motion of said take-up lever in which insufficient slack thread is provided in order to make unthreading possible.

* * * * *